US009295999B2

(12) United States Patent
Yamasaki et al.

(10) Patent No.: US 9,295,999 B2
(45) Date of Patent: Mar. 29, 2016

(54) ROTARY ATOMIZING PAINTING DEVICE

(75) Inventors: Isamu Yamasaki, Toyota (JP); Michio Mitsui, Yokohama (JP); Yoshiharu Yokomizo, Aichi (JP); Toshio Hosoda, Yokohama (JP)

(73) Assignees: Toyota Jidosha Kabushiki Kaisha, Toyota-shi, Aichi (JP); Ransburg Industrial Finishing K.K., Yokohama-shi, Kanagawa (JP)

( * ) Notice: Subject to any disclaimer, the term of this patent is extended or adjusted under 35 U.S.C. 154(b) by 12 days.

(21) Appl. No.: 13/821,248

(22) PCT Filed: Sep. 8, 2011

(86) PCT No.: PCT/JP2011/070443

§ 371 (c)(1),
(2), (4) Date: Apr. 18, 2013

(87) PCT Pub. No.: WO2012/033155

PCT Pub. Date: Mar. 15, 2012

(65) Prior Publication Data

US 2013/0206874 A1 Aug. 15, 2013

(30) Foreign Application Priority Data

Sep. 9, 2010 (JP) ..... 2010-202287

(51) Int. Cl.
*B05B 5/00* (2006.01)
*B05B 5/03* (2006.01)
*B05B 5/04* (2006.01)

(52) U.S. Cl.
CPC ..... *B05B 5/03* (2013.01); *B05B 5/0407* (2013.01); *B05B 5/0426* (2013.01)

(58) Field of Classification Search
USPC ..... 239/703
See application file for complete search history.

(56) References Cited

U.S. PATENT DOCUMENTS

| | | | | |
|---|---|---|---|---|
| 4,776,520 | A * | 10/1988 | Merritt | 239/700 |
| 6,050,499 | A * | 4/2000 | Takayama et al. | 239/112 |
| 6,899,279 | B2 * | 5/2005 | Seitz | 239/7 |
| 8,794,177 | B2 * | 8/2014 | Shigekura et al. | 118/323 |
| 2004/0195406 | A1 * | 10/2004 | Murai et al. | 239/700 |

FOREIGN PATENT DOCUMENTS

| | | |
|---|---|---|
| EP | 2 058 053 A1 | 5/2009 |
| JP | 57-25739 | 6/1982 |
| JP | 60-86468 | 6/1985 |
| JP | 8-99052 | 4/1996 |

(Continued)

*Primary Examiner* — Len Tran
*Assistant Examiner* — Adam J Rogers
(74) *Attorney, Agent, or Firm* — Finnegan, Henderson, Farabow, Garrett & Dunner, LLP

(57) ABSTRACT

The rotary atomizing painting device is provided with a bell cup (3) disposed at the most front part in the paint spray direction X and axially supported by a rotating shaft (2*b*) and a shaping air ring (4) disposed rearward of this bell cup (3) in the paint spray direction and in which a plurality of discharge openings (4*a*) is formed on the periphery centered on the rotating shaft (2*b*). The plurality of discharge openings (4*a*) is formed such that the axial direction of the plurality of discharge openings (4*a*) is in a direction and a slant to the rotating shaft (2*b*). The axial direction of the plurality of discharge openings (4*a*) is formed to aim at a back surface part (3*b*), which is a part on the back surface side of the bell cup (3) from the paint spray direction.

4 Claims, 9 Drawing Sheets

(56) References Cited

FOREIGN PATENT DOCUMENTS

| | | |
|---|---|---|
| JP | 2560421 | 12/1996 |
| JP | 2600390 | 4/1997 |
| JP | 9-239296 | 9/1997 |
| JP | 2008-93521 | 4/2008 |

* cited by examiner (a)

FIG. 4

| | | Conventional | | Present embodiment | |
|---|---|---|---|---|---|
| | | (1)General | (2)Metallic | (3)Painting Gun 1 | |
| Shaping Air | Blow Direction | Straight | Skew | Skew Direction | |
| | Aim At | Back | Edge | Back | |
| | Air Pressure | 0.15MPa | 0.15MPa | 0.15MPa | 0.08MPa |
| RPM | | 25,000rpm | 25,000rpm | 25,000rpm | 20,000rpm |
| Atomization | Average Drop Size | 36.4μm | 24.7μm | 24.3μm | 36.4μm |
| Blow Pattern | Range of Painting Pattern | 430mm | 300mm | 420mm | 420mm |

(a)

(b)

ROTARY ATOMIZING PAINTING DEVICE

TECHNICAL FIELD

The present invention relates to a rotary atomizing painting device that is used in electrostatic painting as well as general painting.

BACKGROUND ART

Conventionally, a rotary atomizing painting device is broadly used in electrostatic coating for a vehicle body or the like.

In the field of such painting device, there is a need for shortening the painting time. However, there is a limit to shorten the cycle time by speeding up a painting robot. Now, the techniques of keeping the speed of the painting robot and widening the painting pattern are addressed. If the painting pattern can be expanded, the overlapped area of the paints becomes larger and the travelling distance of the robot is shortened, thereby shortening the painting time.

As to the conventional painting device, if the area of painting is enlarged, the atomization performance may be limited, and if the atomization performance is prioritized, the painting pattern cannot be easily widened.

JP H03-101858 A discloses the technique of widening the painting pattern while maintaining the atomization performance.

In JP H03-101858 A, a shaping air rotating in the same direction of the rotary atomizing head aims at the end of the head or just outside it.

The shaping air disperses travelling helically, and the centrifugal force acts against the negative pressure created in front of the head, whereby the shaping air can travel without centering. Due to the structure, the paints can be sufficiently atomized and the painting pattern can be enlarged.

CITATION LIST

Patent Literature

PTL 1: JP H03-101858 A

SUMMARY OF INVENTION

Technical Problem

The rotary atomizing painting device of JP H03-101858 A is not used for electrostatic painting but for metallic painting, in which the range of the painting pattern is smaller than the electrostatic painting, so that the conventional metallic painting fails to shorten the painting time. Moreover, regarding such rotary atomizing painting device, even if the blow amount of the shaping air is increased, the range of the painting pattern may not be enlarged.

As mentioned above, there are no rotary atomizing painting devices, which can be used for general electrostatic painting, capable of keeping the atomization performance and of enlarging the range of the painting pattern.

The objective of the present invention is to provide a rotary atomizing painting device that is employable as an electrostatic painting device and capable of widening the range of the painting pattern while maintaining the atomization performance.

Technical Solutions

The objective to be solved is described above, and the technical solutions are followed below.

The first aspect of the invention is a rotary atomizing painting device that includes a bell cup disposed at the most front side in a spraying direction, pivoted on a rotating shaft; and a shaping air ring disposed at the back side of the bell cup, comprising multiple discharge openings for blowing out a shaping air formed on a circle centered on the rotating shaft. The direction of the discharge opening and the rotating shaft are skew, and the discharge opening aims at the back face of the bell cup.

In the advantageous embodiment, the shaping air blown out from the discharge openings forms a swirl flow in a direction opposite to the rotating direction of the bell cup.

More preferably, the bell cup comprises a straight portion located continuously to the front end of the back portion, formed in a column shape centered on the rotating shaft.

Advantageous Effects of Invention

According to the present invention, the following effects are obtained.

According to the first aspect of the invention, the painting pattern can be widened.

According to the advantageous embodiment of the invention, the painting pattern can be widened, and the atomization performance can be improved.

According to the preferable embodiment of the invention, the desired painting pattern can be easily provided.

BRIEF DESCRIPTION OF DRAWINGS

FIG. 4 is a table showing effects (atomization performance and range of painting pattern) of the painting gun.

DESCRIPTION OF EMBODIMENTS

The description of embodiments according to the present invention is followed.

Figure 1:
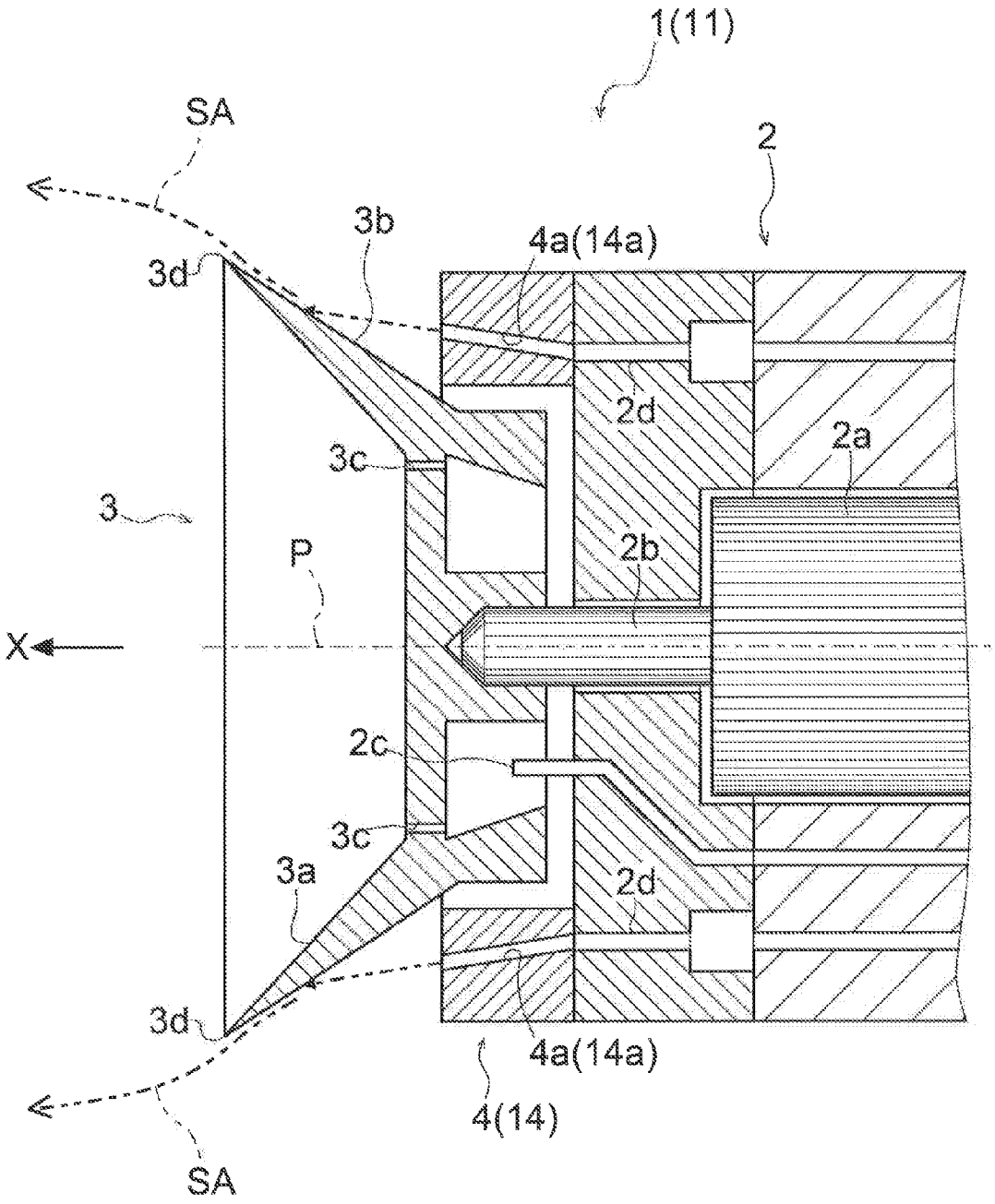
FIG. 1 depicts the side view of a painting gun according to a first embodiment.

Referring to FIGS. 1 to 4, the rotary atomizing painting device as the first embodiment is described below. In FIG. 1, the arrow X directs a spray direction of paints, which is defined as front of the device.

FIG. 1 depicts a painting gun 1 as the first embodiment for spraying paints to a material to be painted by electrostatic painting. The painting gun 1 includes a gun body 2, a bell cup 3, and a shaping air ring 4.

The gun body 2 is supported by a robot arm for changing the position and the angle of the painting gun 1. The bell cup 3 and the shaping air ring 4 are attached to the gun body 2. The gun body 2 has an air motor 2*a* that has a rotating shaft 2*b* projected toward the front side.

The gun body 2 includes a paint pipe 2*c* for feeding the paints to the bell cup 3, multiple air pipes 2*d* for feeding air to the shaping air ring 4, and a high-voltage generator for applying the high voltage to the gun body.

The bell cup 3 rotates and acts the centrifugal force on the paints, thereby dispersing the paints. The bell cup 3 is formed in a bell shape having a concave portion at the front side.

The bell cup 3 is pivoted on the rotating shaft 2*b*, and the rotating center of the bell cup matches the axis P of the rotating shaft 2*b*. The bell cup 3 is disposed at the most front in the spraying direction X of the painting gun 1.

The bell cup 3 has a spreading portion 3*a* for spreading the paints, and multiple paint holes 3*c* for feeding the paints to the spreading portion 3*a*. The paint holes 3*c* are connected to the paint pipe 2*c*.

The spreading portion 3*a* is disposed at the front side being open toward the spraying direction X, and the bell cup 3 has a back portion 3*b* disposed at the back side of the bell cup. Between the spreading portion 3*a* and the back portion 3*b*, there is an edge portion 3*d*.

The shaping air SA blows through the shaping air ring 4. In the spreading portion 3*a*, the paints are spread from the axis of the rotating shaft 2*b* to the outside and spatter out of the outer peripheral of the bell cup 3. The paints spattering out of the bell cup are guided along the shaping air SA, thereby spraying the paints in the desired range of the painting pattern.

The shaping air ring 4 is a ring member and attached to the gun body 2 at the back side of the bell cup 3. The axis of the shaping air ring matches the axis P of the rotating shaft 2*b*.

The shaping air ring 4 has multiple discharge openings 4*a*.

Figure 2:
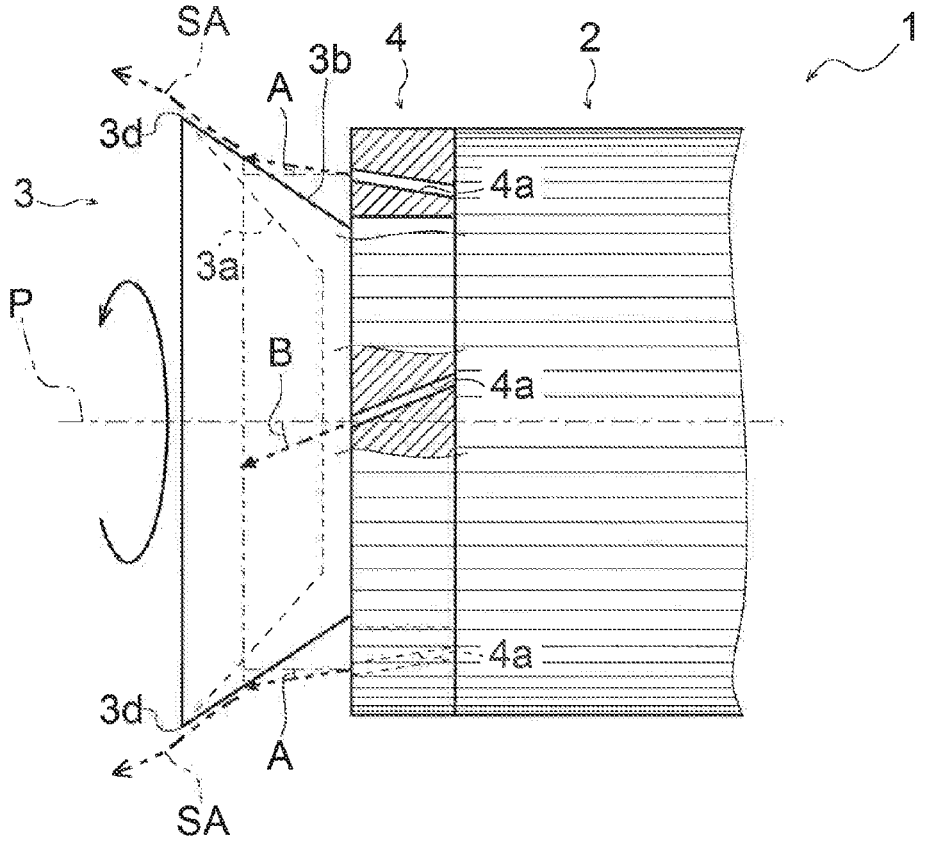
FIG. 2 depicts the painting gun, (a) shows the side view, and (b) shows the top view.
Figure 2:
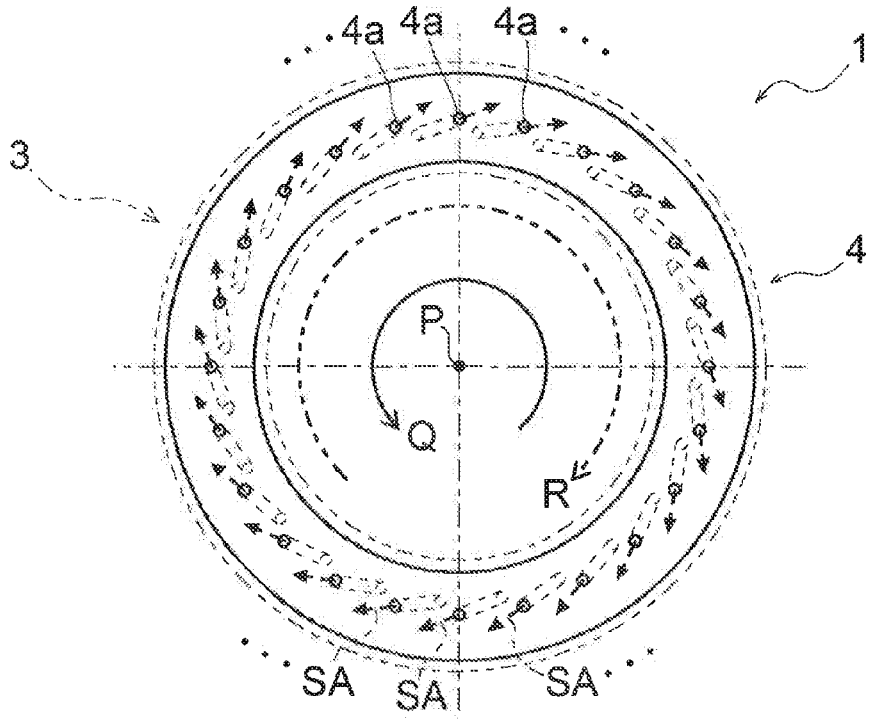

As depicted in FIG. 2(*b*), the discharge openings 4*a* are arranged on a circle centered on the axis P, viewed from the front side. As depicted in FIG. 2(*a*), each of the discharge openings 4*a* makes angle A with the axis P, viewed from the side, and makes angle B with the axis P, viewed from the top. Thus, the direction of the opening 4*a* and the axis P are skew.

Each of the openings 4*a* is formed such that the extended line of the opening intersects the back portion 3*b* located in the back side of the bell cup 3.

In the painting gun 1, the shaping air SA discharged from the openings 4*a* touches the back portion 3*b* and disperses along the slant of the back portion 3*b*.

The slant angle (or inclination angle) of the back portion 3*b* is defined as the angle between the line perpendicular to the axis P and the back portion 3*b*.

As described above, the shaping air SA discharged from the openings 4*a* aims at the back portion 3*b* of the bell cup 3, and the shaping air SA follows the back portion 3*b* and forms a swirl flow with expanding diameter as it goes to the material to be painted.

Figure 3:
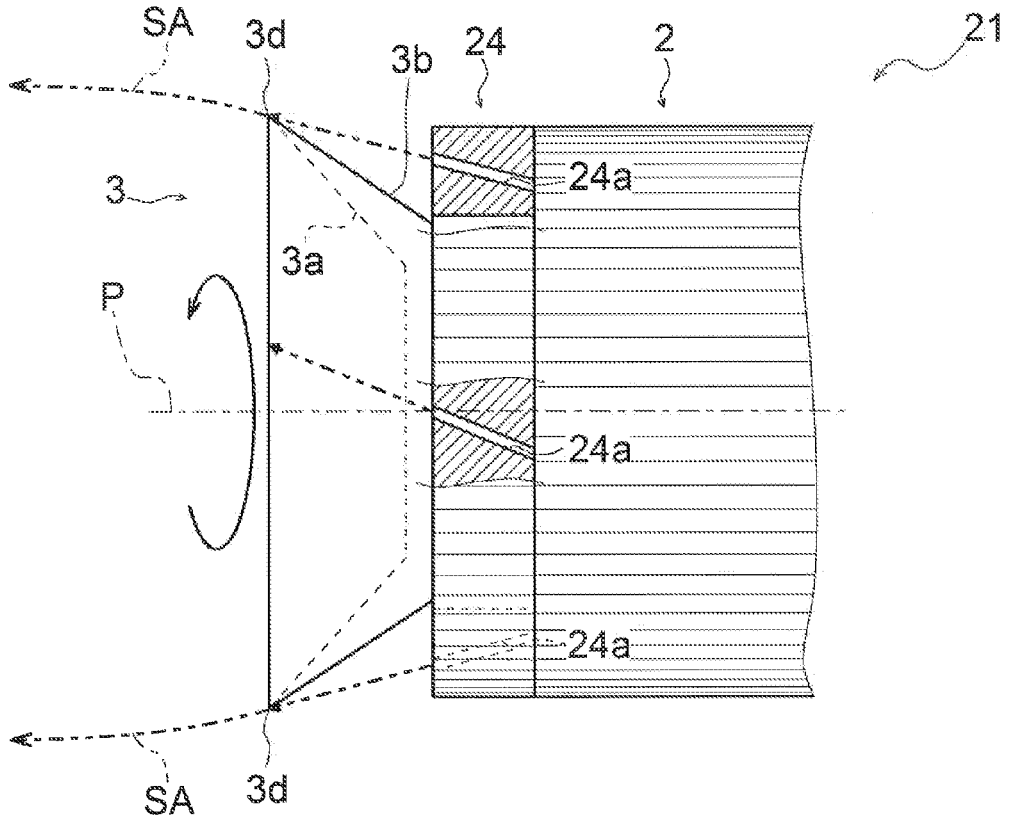
FIG. 3 is a side view illustrating a conventional painting gun.

FIG. 3 depicts a conventional painting gun 21. The conventional gun 21 has a shaping air ring 24 formed with discharge openings 24*a*. In this case, the shaping air SA aims at the edge portion 3*d* or the outside thereof, so that the shaping air forms the swirl flow corresponding to the direction of the opening 24*a* without affecting the slant of the back portion 3*b*.

As the result, the air blow toward the outside in the radial direction of the bell cup 3 is not formed in the conventional gun 21. The negative pressure generated in front of the bell cup 3 makes the painting pattern small.

As depicted in FIG. 2(*a*), regarding the painting gun 1, the shaping air SA is blown out along the inclination of the back portion 3*b*, and therefore the shaping air flows toward the outside in the radial direction of the bell cup 3. As a result, the shaping air works for widening the painting pattern without affecting the negative pressure generated in front of the bell cup 3.

Furthermore, as depicted in FIG. 2(*b*), the shaping air SA discharged from the openings 4*a* forms the swirl flow in the direction R opposite to the rotating direction Q of the bell cup 3.

Thus, the rotating direction of the shaping air SA (direction R) is counter direction of the rotating direction Q of the bell cup 3, and the shaping air SA intersects and collides with the paints scattered from the edge portion 3*d* of the bell cup 3. Therefore, atomization of the paints is accelerated.

The effects of the painting gun 1, i.e., enlargement of painting pattern and atomization of paints, are described below.

FIG. 4 shows results of average drop size and paint range, in which three painting guns—(1) a general painting gun, (2) a painting gun for metallic painting and (3) the painting gun according to the embodiment—are used in a same condition (air pressure: 0.15 MPa, and bell cup: 25,000 rpm).

As shown in FIG. 4, the conventional painting gun is configured to blow the shaping air straightly toward the back face of the bell cup.

In this example, the average drop size is 36.4 μm.

The paint range is 430 mm in width.

The painting gun is configured to how the shaping air helically toward the edge of the bell cup (or outside it).

In this example, the average drop size is 24.7 μm.

The paint range is 300 mm in width.

As to the conventional painting devices, the general painting gun is superior to the metallic painting gun in view of painting range, and the metallic painting gun is superior to the general painting gun in view of atomization.

The painting gun 1 is configured to blow the shaping air SA in skew direction with respect to the bell cup toward the back face of the bell cup.

In that case, the average drop size is 24.3 μm, which is almost equal to the result of the metallic painting gun.

The paint range is 420 mm in width, which is almost equal to the result of the general painting gun.

The painting gun 1 can provide the comparable results to the metallic painting gun with respect to the atomization and to the general painting gun with respect to the range of painting pattern.

In the painting gun 1, the drill direction of each discharge openings 4*a* is defined such that the shaping air SA blown out from the openings 4*a* forms the swirl flow in the direction R counter to the rotating direction Q of the bell cup 3.

Due to the structure, the painting pattern is enlarged and the paints are sufficiently atomized.

As the result, the painting gun 1 provides shortening the painting time and coating even thickness paints, thereby improving the painting property.

As shown in FIG. 4, if the painting gun 1 is required to atomize the paints as the same as the general painting gun (i.e., if the average drop size can be around 36.4 μm), the amount of the shaping air SA may be decreased.

In such case, if the air pressure is decreased to 0.08 MPa, and the rotation speed of the bell cup is decreased to 20,000 rpm, the average drop size is 36.4 μm. This result shows the painting gun 1 can achieve the equivalent atomization to the conventional painting gun.

The range of the painting pattern is 420 mm in this case, so that the painting gun 1 can maintain the equivalent condition to the conventional painting gun.

The decrease of the air pressure and the rotation speed of the bell cup can reduce the amount of air. Thus, the painting gun 1 can provide the reduce usage of air, keeping the same painting quality as the conventional gun.

Reducing the usage of air leads not only reduce the running cost, but also improve the adhesion rate of paints, because the amount of excess air being contribute not at all to the electrostatic painting is reduced and dispersing amount of paints accompanied with the excess air.

As described above, the painting gun 1 as the first embodiment includes the bell cup 3 that is disposed at the most front in the spraying direction (arrow X in FIG. 1) and rotative around the rotating shaft 2*b*, and the shaping air ring 4 that is disposed at the back of the bell cup 3 and formed with the multiple discharge openings 4*a*, which are arranged on the circle centered on the rotating shaft 2*b*. The direction of each opening 4*a* is set in the skew with respect to the rotating shaft 2*b* and aims at the back portion 3*b* of the bell cup 3.

Such structure provides the increase of the range of painting.

Figure 5:
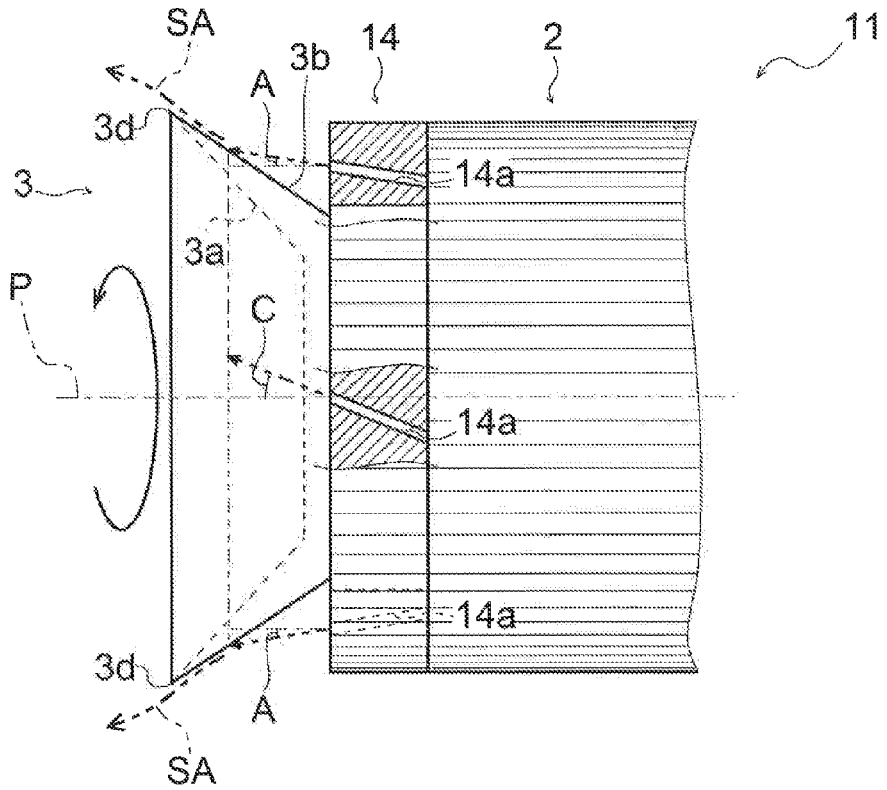
FIG. 5 depicts the side view of a painting gun according to a second embodiment.
Figure 5:
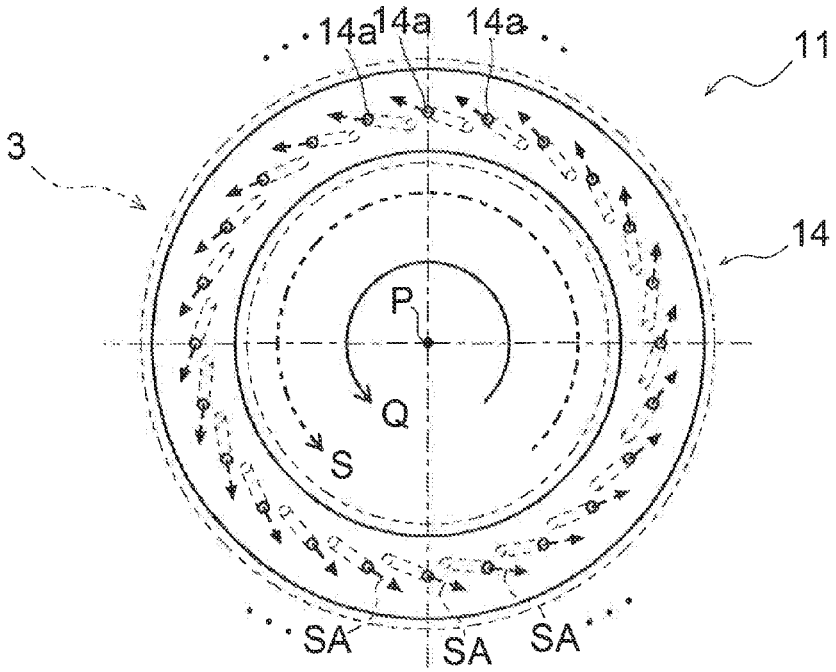

Referring to FIGS. 1 and 5, the rotary atomizing painting device as the second embodiment is described below.

En the painting gun 1 of the first embodiment, the blow direction R of the shaping air SA is opposite to the rotating direction Q of the bell cup 3, however, the blow direction of the shaping air SA may be same as the rotating direction Q.

As depicted in FIG. 1, a painting gun 11 of the second embodiment includes the common structure of the painting gun 1 except a shaping air ring 14 formed with multiple discharge openings 14*a*, the direction of which is different from that of the openings 4*a*.

As depicted in FIG. 5(*b*), the discharge openings 14*a* are arranged on a circle centered on the axis P, viewed from the front side. As depicted in FIG. 5(*a*), each of the discharge openings 14*a* makes angle A with the axis P, viewed from the side, and makes angle C with the axis P, viewed from the top. Thus, the direction of the opening 14*a* and the axis P are skew.

As depicted in FIG. 5(*b*), the shaping air SA discharged from the openings 14*a* forms the swirl flow in the direction S being same as the rotating direction Q of the bell cup 3.

In such case that the direction S is same as the rotating direction Q of the bell cup 3, the painting pattern can be enlarged as the painting gun 1.

Figure 6:
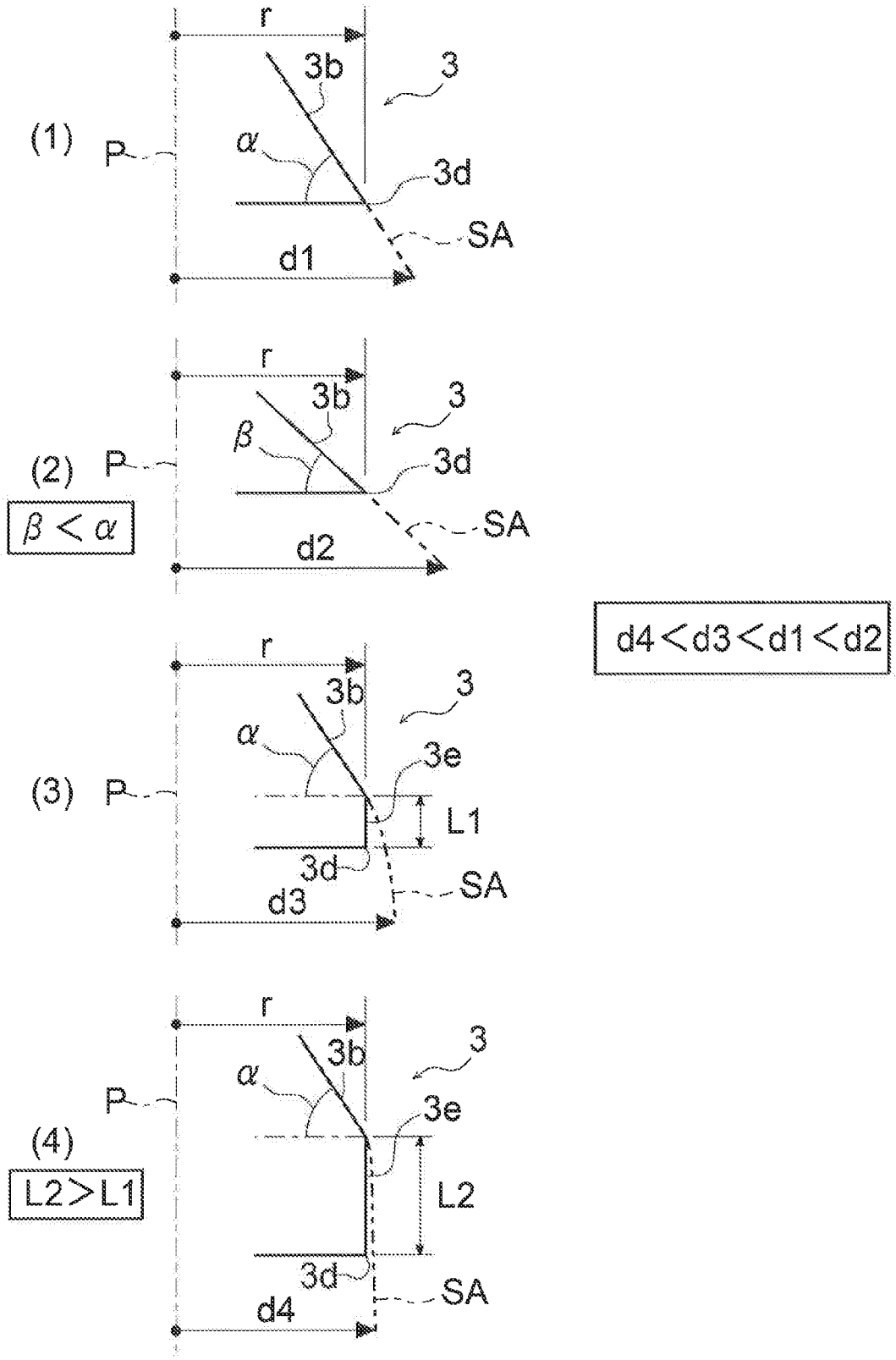
FIG. 6 illustrates painting patterns (1) to (4), each of which corresponds to a shape of a bell cup.

Referring to FIG. 6, how to change the painting pattern in the painting guns 1 and 11 is described below.

In the painting guns 1 and 11, the shaping air SA is blown along the back portion 3*b* of the bell cup 3, so that the shape of the back portion 3*b* can adjust the painting pattern.

As shown in FIG. 6, the slant angle between the line perpendicular to the axis P and the back portion 3*b* is changeable so that the dispersing condition of the shaping air SA is changed to adjust the painting pattern.

The slant angle of the back portion 3*b* is defined as the angle between the line perpendicular to the axis P and the back portion 3*b*. The diameter r of the edge portion 3*d* of the bell cup 3 is constant.

As shown in FIG. 6, the width d1 of the painting pattern when the slant angle α (pattern (1) in FIG. 6) of the back portion 3*b* is defined as standard. When the bell cup 3 has the slant angle β (pattern (2) in FIG. 6) of the back portion 3*b*, which is smaller than the slant angle α, results in the width d2 larger than the width d1.

The painting guns 1 and 11 can change the blowing condition of the shaping air SA by changing the inclination angle of the back portion 3*b* of the bell cup 3.

Due to the structure, the painting guns can easily provide the desired painting pattern.

As depicted in FIG. 6, in the painting guns 1 and 11, the slant angle of the back portion 3*b* is the angle α, and the back portion 3*b* is continued to a straight portion 3*e* that is formed in column shape centered on the axis P. In this embodiment, the straight portion 3*e* is disposed between the back portion 3*b* and the edge portion 3*d*.

The length of the straight portion 3*e* along the axis P is changeable to adjust the painting pattern.

As shown in FIG. 6, the width d1 of the painting pattern when the slant angle α (pattern (1) in FIG. 6) of the back portion 3*b* is defined as standard. When the bell cup 3 has the slant angle α and the length of the straight portion 3*e* is set in length L1 (pattern (3) in FIG. 6), the width d3 of the painting pattern is smaller than the width d1.

When the bell cup 3 has the slant angle α and the length of the straight portion 3*e* is set in length L2, which is longer than the length L1 (pattern (4) in FIG. 6), the width d4 of the painting pattern is smaller than the width d3.

The shaping air SA travels along the back portion 3*b* and the straight portion 3*e*, so that as the straight portion 3*e* become longer, the width of the painting pattern more approaches the diameter of the straight portion 3*e*.

As described above, each of the painting guns 1 and 11 includes the straight portion 3*e* in the bell cup 3, which is disposed in front of the back portion 3*b* and formed in the column shape of which axis is parallel to the rotating shaft 2*b* (axis P), and the length of the straight portion is changeable corresponding to the desired blowing condition of the shaping air SA (i.e., the range of the painting pattern).

In such structure, the widths d1 to d4 satisfy the following inequality: d4<d3<d1<d2. Thus, the desired condition of the shaping air can be provided by the combination of the slant angle of the back portion 3*b* and the length of the straight portion 3*e*.

Figure 7:
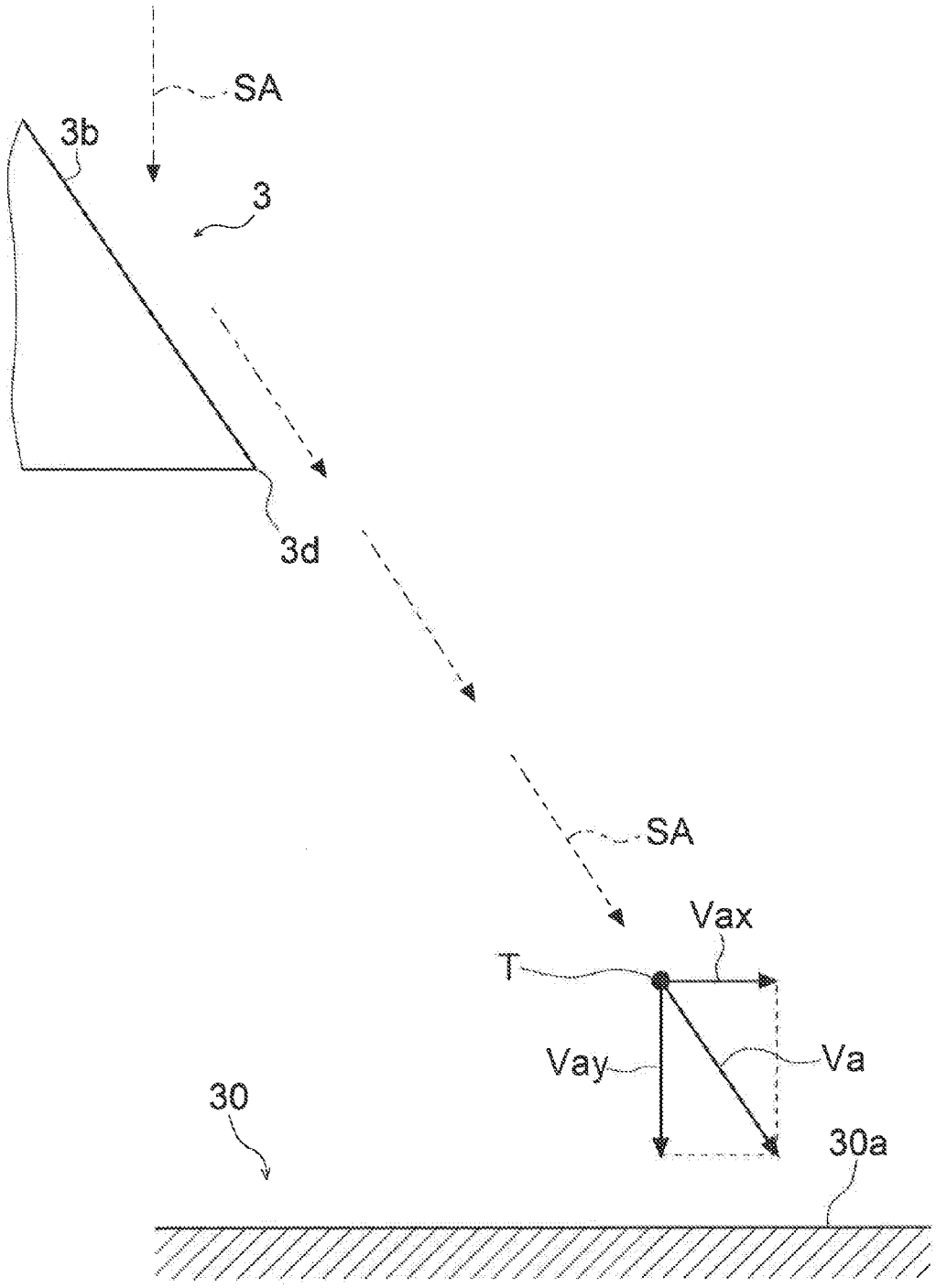
FIG. 7 depicts the bell cup without a straight portion and illustrates the dispersing of paints.
Figure 8:
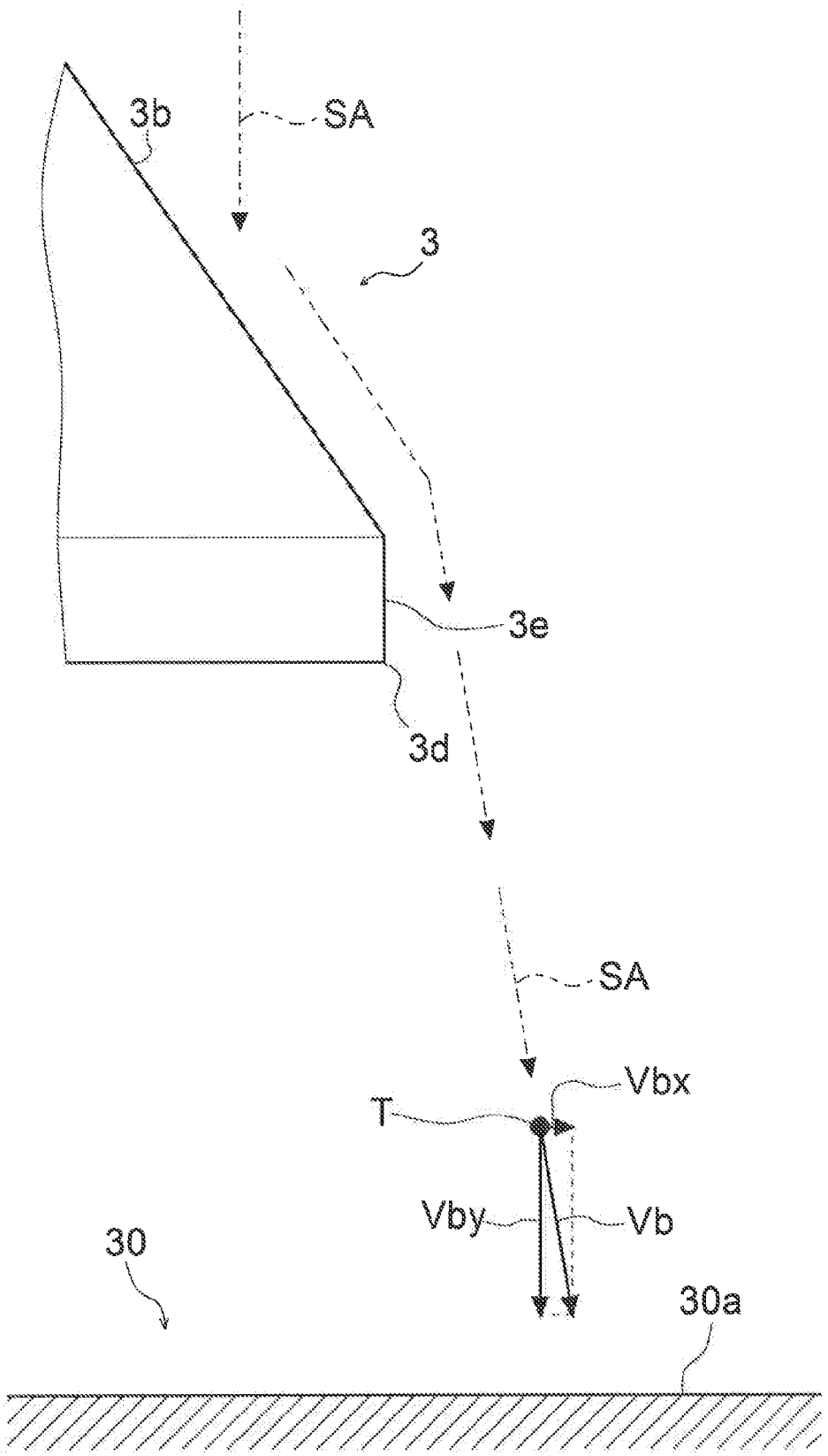
FIG. 8 depicts the bell cup with a straight portion and illustrates the dispersing of paints.
Figure 9:
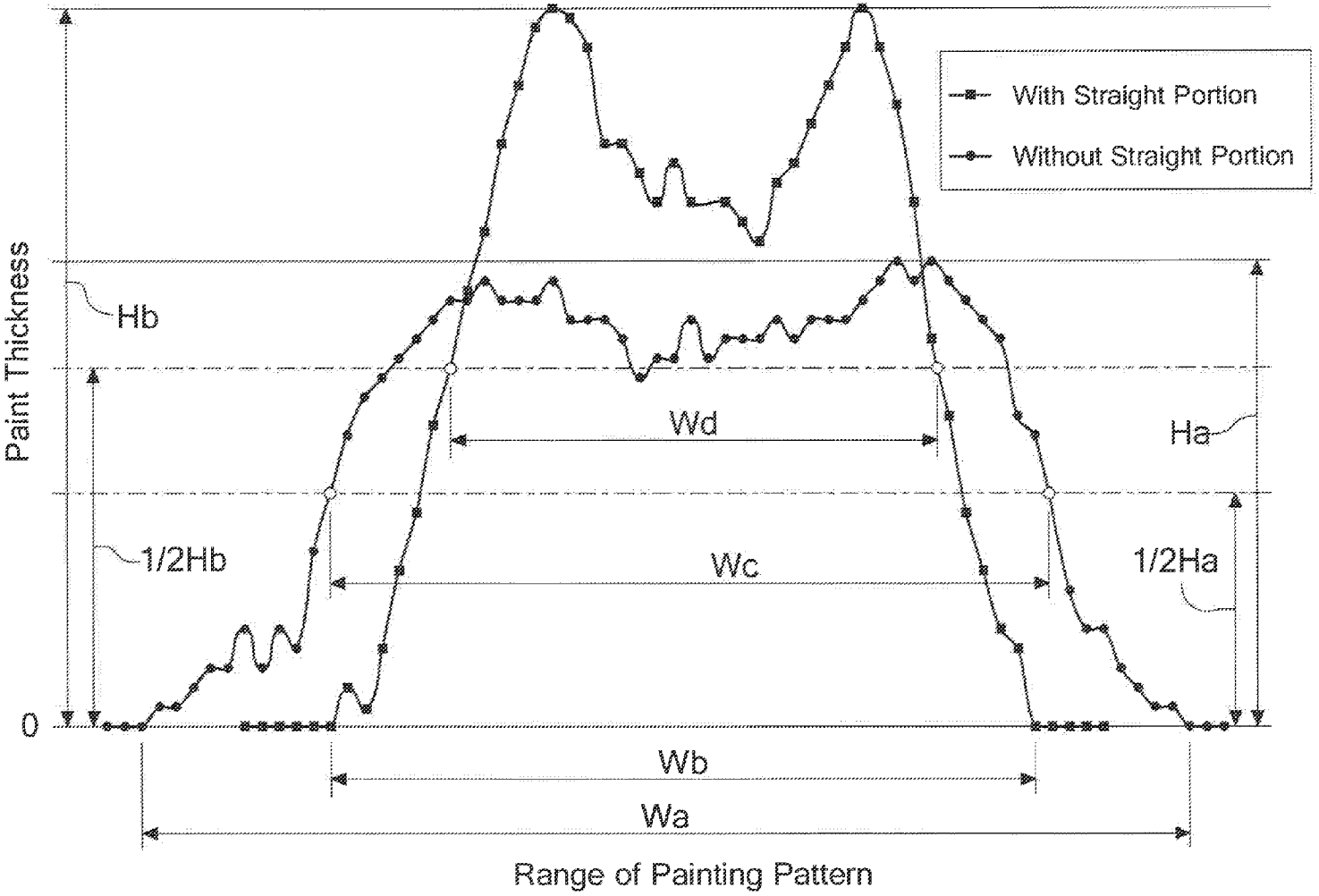
FIG. 9 shows the results of distribution of paint thickness, using the painting guns each of which having the bell cup with or without the straight portion.

Referring to FIGS. 7 to 9, the effects of the straight portion 3*e* is described below.

FIG. 7 depicts the bell cup 3 without the straight portion 3*e*, in which the shaping air SA blown toward the back portion 3*b* expands along the slant angle of the back portion 3*b* and approaches the material to be painted 30.

The paint drop T disperses with the flow of the shaping air SA. Provided the speed of the drop T is Va, the speed Va is divided into Vax and Vay: Vax is the component parallel to the plane to be painted 30*a* of the material 30, and Vay is the component perpendicular to the plane 30*a*.

The component Vay contributes to the adhesion of the paint drop T to the plane 30*a*, and the component Vax prevents the paint drop T from adhering to the plane 30*a*.

FIG. 8 depicts the bell cup 3 with the straight portion 3*e*, in which the shaping air SA blown to the back portion 3*b* expands along the slant angle of the back portion 3*b* and travels straightly along the straight portion 3*e*.

Provided the speed of the drop T is Vb, the speed Vb is divided into Vbx and Vby: Vbx is the component parallel to the plane 30*a*, and Vby is the component perpendicular to the plane 30*a*.

The component Vby contributes to the adhesion of the paint drop T to the plane 30*a*, and the component Vbx prevents the paint drop T from adhering to the plane 30*a*.

Here, comparing the speed components in the two embodiments with or without the straight portion 3*e*, the components Vay and Vby are substantially same. On the other hand, the components Vax and Vbx, which prevent the paint drop T from adhering to the material 30, are significantly different, and the component Vbx is much smaller than the component Vax.

As the result, in the embodiment with the straight portion 3*e*, the element (speed component Vbx) for preventing the paint drop T from adhering to the material to be painted 30 is small, whereby the adhesion rate of paints can be improved.

FIG. 9 shows the results of distribution of paint thickness, using the painting guns each of which having the bell cup 3 with or without the straight portion 3*e*.

Generally, a width of the painting pattern is defined as the width where the thickness is half the maximum thickness. Here, the maximum thickness when the painting is performed by the painting gun without the straight portion 3*e* is defined as Ha, and that when the painting is performed by the painting gun with the straight portion 3*e* is defined as Hb.

In the case that the straight portion 3*e* is not provided, the maximum width is defined as Wa, and the width of painting pattern where the paint thickness is ½ Ha is defined as Wc.

In the case that the straight portion 3*e* is provided, the maximum width is defined as Wb, and the width of painting pattern where the paint thickness is ½ Hb is defined as Wd.

FIG. 9 says that the pattern width Wd (with straight portion 3*e*) is smaller than the pattern width Wc (without straight portion 3*e*).

The maximum width Wb (with straight portion 3*e*) is smaller than the maximum width Wa (without straight portion 3*e*).

In the case where the painting gun includes the straight portion 3*e*, the maximum width Wb (width of the periphery) can be small, and the variation in thickness at the end portion appears clearly, in other words, the shape of thickness distribution gets close to trapezoid. The thickness distribution is prevented from varying, thereby securing the painting quality when overlapping the paints easily.

In the case were the painting gun includes the straight portion 3*e*, the width Wc of the painting pattern can be small, so that the overspray can be avoided in comparison with the painting gun without straight portion 3*e*. Therefore, the paint yield can be enhanced, thereby reducing the usage of the paints.

As described above, each of the painting guns 1 and 11 includes the bell cup 3 formed with the straight portion 3*e* between the hack portion 3*b* and the edge portion 3*d*.

Due to the structure, the painting guns can easily provide the desired painting pattern.

INDUSTRIAL APPLICABILITY

The present invention is applicable not only to a rotary atomizing painting device for electrostatic painting but also to a general rotary atomizing painting device.

The invention claimed is:

1. A rotary atomizing painting device, comprising:

a bell cup disposed at a front side in a spraying direction, pivotable on a rotating shaft; and a shaping air ring disposed at a back side of the bell cup, comprising multiple discharge openings for blowing out a shaping air formed on a circle centered on the rotating shaft, wherein the direction of the discharge openings and the rotating shaft are skew, the discharge openings aim at a back face of the bell cup, the bell cup comprises a straight portion that is continuous with a front end of the back face, formed in a column shape centered on the rotating shaft, wherein the back face includes an angled portion that transitions into the straight portion as the bell cup extends away from the discharge openings, and a length of the straight portion at least in part defines a painting pattern produced by the painting device.

2. The rotary atomizing painting device of claim 1, wherein the straight portion extends away from the discharge openings as it extends away from the angled portion.

3. The rotary atomizing painting device of claim 1, wherein each discharge opening extends along an associated axis, and wherein each associated axis intersects the back face of the bell cup.

4. The rotary atomizing painting device of claim 3, wherein the rotating shaft extends along an axis of rotation, and wherein the axis of rotation and each associated axis of the discharge openings is skew.

* * * * *